US007611009B2

(12) United States Patent
Youngs

(10) Patent No.: US 7,611,009 B2
(45) Date of Patent: Nov. 3, 2009

(54) PAINT TRAY WITH MECHANICALLY-OPENING LID

(76) Inventor: Darren J. Youngs, 54120 Douglas Dr., Plainfield, IL (US) 60544

( * ) Notice: Subject to any disclaimer, the term of this patent is extended or adjusted under 35 U.S.C. 154(b) by 501 days.

(21) Appl. No.: 11/236,476

(22) Filed: Sep. 27, 2005

(65) Prior Publication Data

US 2006/0054627 A1 Mar. 16, 2006

(51) Int. Cl.
*B65D 73/00* (2006.01)

(52) U.S. Cl. ..... 206/81; 206/361; 220/263; 220/827

(58) Field of Classification Search ..... 206/361, 206/362, 362.1, 362.2, 362.3, 15.2, 15.3, 206/81, 557, 560; 220/262, 263, 264, 827
See application file for complete search history.

(56) References Cited

U.S. PATENT DOCUMENTS 3,299,915 A * 1/1967 Clark ..... 141/231
4,547,926 A 10/1985 Kern
4,651,379 A 3/1987 Kern
4,669,609 A 6/1987 Lugo
4,834,237 A 5/1989 Henke et al.
5,085,317 A 2/1992 Jensen et al.
5,273,160 A 12/1993 Malvasio
5,314,061 A 5/1994 Bedrossian
5,316,137 A 5/1994 Kyllonen
5,372,271 A * 12/1994 Miller et al. ..... 220/263
5,404,611 A 4/1995 Raney
5,511,279 A 4/1996 Ippolito
5,533,228 A 7/1996 Jareckik et al.
5,533,701 A 7/1996 Trank
5,553,701 A 9/1996 Jarecki et al.
5,645,164 A 7/1997 Hocking
5,673,810 A * 10/1997 Rothrock ..... 220/264
5,787,544 A 8/1998 Meade
5,960,946 A 10/1999 Gramlich
5,984,129 A 11/1999 Pasinski
6,267,260 B1 * 7/2001 Lyons ..... 220/212.5
6,390,321 B1 * 5/2002 Wang ..... 220/264
2002/0079792 A1 * 6/2002 Nott et al. ..... 312/248
2003/0015542 A1 * 1/2003 Nulty et al. ..... 220/780
2003/0102339 A1 * 6/2003 Walsh et al. ..... 222/567
2003/0133356 A1 * 7/2003 Williams ..... 366/192
2003/0183633 A1 * 10/2003 Pope ..... 220/263
2003/0217941 A1 * 11/2003 MacPherson et al. ..... 206/362
2004/0164095 A1 * 8/2004 Walsh et al. ..... 222/111
2004/0195248 A1 * 10/2004 Garcia ..... 220/570
2004/0226958 A1 * 11/2004 Robellard et al. ..... 220/772
2004/0238399 A1 * 12/2004 Billado, Jr. ..... 206/564
2005/0252920 A1 * 11/2005 Cumming et al. ..... 220/570

* cited by examiner

*Primary Examiner*—Jacob K Ackun, Jr.
(74) *Attorney, Agent, or Firm*—Brinks Hofer Gilson & Lione

(57) ABSTRACT

A paint tray including a mechanically-openable lid and a mechanism for opening the lid.

18 Claims, 4 Drawing Sheets

(actual contours preferably are rounded, with a substantially circular or other rounded cross-section)

PAINT TRAY WITH MECHANICALLY-OPENING LID

FIELD OF THE INVENTION

The present invention relates generally to a paint tray, and more particularly to paint tray with a mechanically-opening lid.

BACKGROUND

Sealable paint tray assemblies and paint kits, or more generally, wet architectural coating and coating applicator storage containers are well-known in the field of home improvement and decoration. For convenience of description, reference will hereafter be made to "paint" as representative generally of architectural coatings. References will hereafter be made to "paint kit" as representative generally of a paint applicator such as a roller assembly (a roller handle and removable sleeve), brush, or paint sponge and a paint tray with a paint reservoir and an angled surface for removing excess paint from the paint applicator.

Conventional roller painting equipment comprising a paint kit used by professionals or private consumers typically consists essentially of a roller assembly and a paint tray. During use of the paint kit, a quantity of paint is poured into the tray reservoir, which typically has a storage capacity considerably less than the volume of the paint container. The roller sleeve is dipped into the paint in the tray reservoir as the work progresses until the batch of paint is exhausted, at which time another batch of paint is poured into the tray reservoir. Ideally, the paint in the tray will be exhausted at the same time as the person applying the paint quits for the day or otherwise interrupts the painting operation, thereby leaving the paint tray open for an extended period of time. However, this fortuitous timing does not often happen, and paint is left in the tray and on the roller or other applicator. This paint will skin over or harden due to solvent evaporation. As a consequence, when leaving the paint kit for a long enough time period, the user has the option of (1) throwing out or cleaning the roller sleeve and pouring the unused paint back into the original container, which is almost invariably a messy and time-consuming process with the potential for spillage on a floor or carpeted surface, or (2) leaving the roller assembly and unused paint in the tray until the user can return to finish the job. If the paint is left in the tray, removing the skin that forms over the paint reservoir is an even messier task than pouring out the unused paint with all the above described disadvantages. If the user elects the latter option, as a result of solvent evaporation, the paint (which the user hopes is skin-free) will often be thicker than when it was poured from the original container. As a result, the surface covering ability and quality may undesirably be altered in a manner that affects the appearance of the paint after it is applied and dries. Moreover, items like roller sleeves are often replaced once painting is resumed. In addition to being inconvenient, this may become expensive, especially when the painter is using high-quality roller sleeves, but it is often a more popular choice rather than the long, messy, and often aggravating process of washing and drying a roller sleeve at any point when the tray and paint accessories are not to be used for some time.

Attempts have been made to address the above disadvantages by adding a separate lid that can be fitted onto the top of the paint tray. For example, U.S. Pat. No. 4,651,379 to Kern discloses a paint roller tray with a lid to prevent paint therein from drying out, but does not address the issue of the paint in the roller or other applicator. Billado's U.S. Pat. App. Pub. No. 2004/0238399A1 discloses a paint roller tray with a lid and tray structure adapted to provide for storage of the roller in the tray such that the paint the roller and the tray reservoir are sealed to prevent solvent evaporation.

However, the above-described lids do not address another common problem with the use of an open paint tray. Specifically, it is common for paint trays to be used during construction and home improvement projects where tools and construction materials (e.g., nails, masking tape rolls) and/or project detritus (e.g., ceiling spackle, dust) are present and may fall into or contaminate the paint while the tray is in use, with negative effects on the quality of its application. Another problem associated with some of the existing lid devices is that, during a time of storage, they may become unevenly adhered to the contact surfaces of the paint tray. As a result, when a user attempts to remove the lid from the paint tray, it may stick, requiring extra force to be applied such that, if the lid then releases suddenly, the paint tray is upset, spilling paint and/or allowing the roller (if it is stored into the tray) to fall on the floor and become contaminated with detritus therefrom. Additionally, these lids are designed to be placed over the paint tray only at the end of a painting operation or when the user suspends the painting operation for an extended time. Thus, the lids do nothing to mitigate evaporation during a painting operation.

BRIEF SUMMARY

The present invention addresses the above-described problems by providing a paint tray with a mechanically-opening hinged lid. Embodiments of the provided paint tray provide a mechanism for smooth opening and closing of the lid either after storage and/or during use of the paint tray, with the mechanism preferably being actuated by a pedal such as a foot pedal. Optionally, the lid and/or tray may be configured to allow storage of a paint applicator in the tray when the lid is closed The invention includes a paint tray, with a base including a reservoir, a lid hingedly connected to the base, and a mechanism configured to open the lid.

DETAILED DESCRIPTION

Figure 1A:
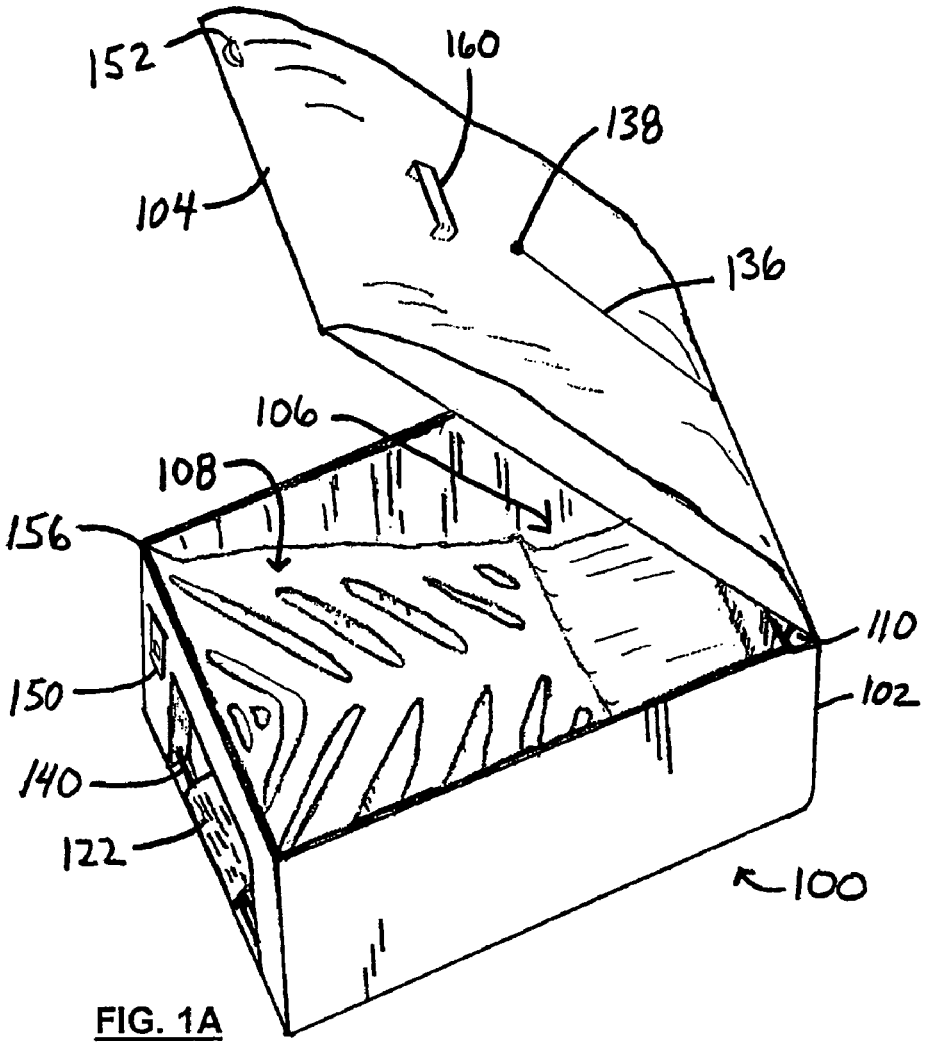
FIG. 1A is a top perspective view of a first paint tray embodiment.
Figure 1B:
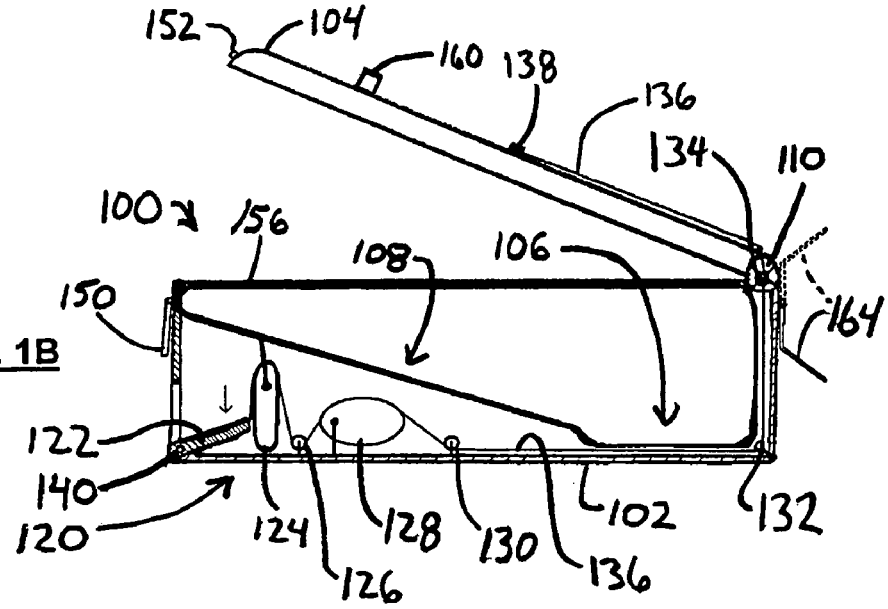
FIG. 1B shows a cut-away side view of the paint tray of FIG. 1A.

FIG. 1A depicts a top perspective view of a paint tray 100 of the present invention, and FIG. 1B shows a cut-away side view of the paint tray 100. The paint tray 100 includes a base 102 and a lid 104. The upper interior portion of the base 102 includes a reservoir region 106 and a ramped region 108. Preferably, the ramped region 108 is configured for convenient removal of excess paint from a brush or roller (e.g., with indentations or other irregular surface feature(s)). Also preferably, the reservoir and ramped regions 106, 108 are sized to accommodate one or more standard-sized paint rollers and disposable paint tray inserts. The lid 104 is connected to the base 102 by a hinge 110. The lower portion of the base 102 includes an opening mechanism 120 for opening the lid 104.

In the illustrated paint tray embodiment, the opening mechanism 120 includes a pedal 122, a series of six pulleys 124, 126, 128, 130, 132, 134, each of which is attached to the base, and a cable 136 that is threaded from the pedal 122 through the pulleys to an attachment 138 on the lid 104. In alternative embodiments, a mechanism other than a cable-and-pulley mechanism may be used. For example, the cable may be replaced with a belt, strap, or chain, and/or other parts of the mechanism may be altered or replaced. Some examples of alternative mechanisms are discussed below. The pedal 122 is attached pivotally to the base 102 by a hinge pin 140, around which the proximal/bottom end of the pedal 122 can rotate. The distal end of the pedal 122 is attached to the cable 136. As shown in FIG. 1B, from the distal end of the pedal 122, the cable 136 wraps clockwise around the first pulley 124, which is oblong and eccentrically mounted to the underside of the ramped region 108. The cable 136 then passes around the underside of the second pulley 126, which is mounted to the bottom of the base 102, and then wraps clockwise around the third pulley 128, which is also oblong and eccentrically mounted to the bottom of the base 102. From the third pulley 128, the cable 136 passes along the underside of the fourth pulley 130 and extends beneath the reservoir region 106 before turning upward around the fifth pulley 132. The cable 136 extends upward from the fifth pulley 132 and proceeds around the sixth pulley 134 to the attachment 138 on the lid 104. Those of skill in the art will appreciate that alternative pulley configurations and other (e.g., non-pulley) configurations for transmitting an opening force to the lid are within the scope of the present invention. Those of skill in the art will appreciate that the "pulleys" described herein function as cams in a manner similar to the elliptical or offset-axis cams used in compound bows and other devices where it is desirable to take up a greater length of, for example, a cable, while using a limited motion and a limited space.

The opening mechanism 120 is configured such that when a user depresses the pedal 122, the resulting tension on the cable 136, as transmitted across the pulleys, pulls open the lid 104 by causing it to rotate relative to the hinge 110. The lid 104 may be easily opened by the user using, for example, her foot to actuate the pedal 122. The lid 104 may be left open while the paint tray 100 is in use, or may be allowed to close whenever the user is not dipping her painting appliance (e.g., paint roller, paintbrush, painting sponge, etc.) into the paint tray. Allowing the tray to close while a user is painting helps to minimize the likelihood of spilling the paint and the likelihood of anything falling into the paint (e.g., ceiling spackle, tools or other loose objects in the room, etc.). A preferred method of use includes a user/painter using a short- or long-handled paint roller and taking the steps of (i) actuating the pedal to open the paint tray, (ii) getting paint on the roller in the normal fashion, (iii) allowing the lid to close, and (iv) repeating the previous steps as needed.

On the front/proximal side the paint tray 100, an optional hasp-type closure structure is included for securing the lid 104 into a closed position. The hasp-type closure structure includes a slotted metal tab 150 that is hingedly attached to the base 102 and a rounded staple-type projection 152 on the proximal/front side of the lid 104. When the lid 104 is in a closed position, the slotted metal tab 150 can be lifted to engage the rounded staple-type projection 152 to keep the paint tray 100 securely closed. Preferably, a frictional fit exists between the rounded staple-type projection 152 and the slotted metal tab 150 such that the paint tray 100 can be moved with the hasp-type closure structure keeping it closed. With the illustrated structure, a clip or even a padlock may be employed to securely keep the lid 104 closed (e.g., to keep children from opening the paint tray 100).

Preferably, the upper edge of the base 102 includes a gasket 156 that helps to seal shut the paint tray 100, thereby helping to minimize solvent evaporation that may thicken paint in the tray or cause a skin to form thereon. Also preferably, the gasket 156 includes a non-stick upper surface (including, for example, PTFE or another non-stick component) so that—even if some paint is deposited between the lid 104 and the gasket 156 when the lid is closed—the likelihood of the lid 104 sticking shut is decreased. In some embodiments, one or both of the lid and base optionally may include magnetized components to help keep the lid in a closed position. Optionally, a handle 160 is provided on top of the lid 104 for easier direct/manual opening of the lid. Another optional feature, illustrated in FIG. 1A, is a rotatable lid-stop 164. The lid-stop 164 may be rotated into an "up position" (illustrated in phantom lines) so that a user may leave the lid 104 in a propped-open predetermined position (e.g., at an angle between 0° and 180°, or more, relative to the base 102). In some embodiments, the lid 104 and/or its hinge 110 may be equipped with a spring configured such that anytime the lid 104 is opened to an angle that is less than, for example, 270°, the spring will cause the lid to close.

In one alternative embodiment, the paint tray 100 may include legs on its bottom. Those legs may include a non-skid feature, such as rubber feet, in order to hold the tray relatively stationary, thereby keeping it from sliding. Alternatively, the legs may include casters, bearings, or a low-friction surface that will allow a user to easily move the paint tray around on a surface such as a floor, without picking it up.

Figure 2A:
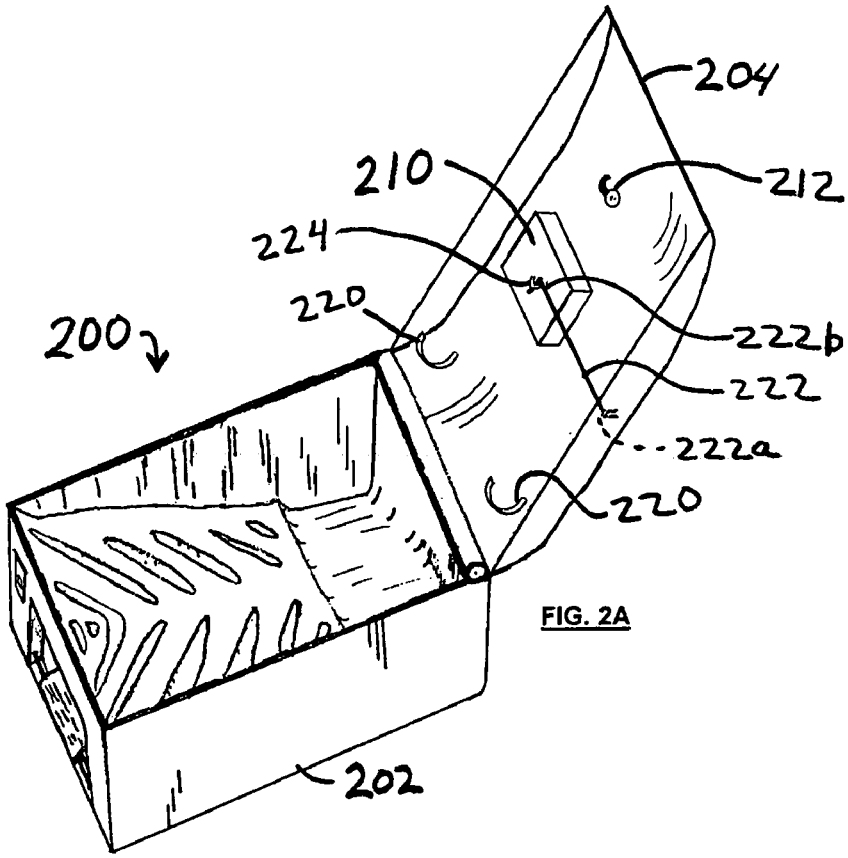
FIG. 2A is a top perspective view of a second paint tray embodiment.
Figure 2B:
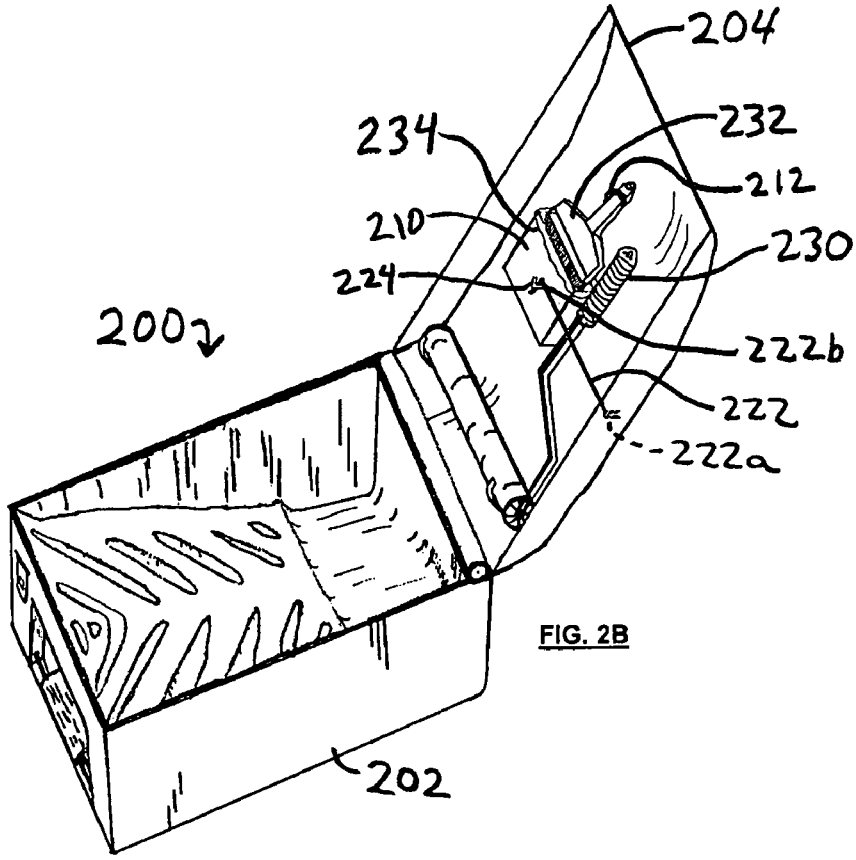
FIG. 2B is a top perspective view of the tray shown FIG. 2A, with a paint roller and a paint brush disposed in the lid

FIGS. 2A and 2B illustrate another embodiment of the invention. In particular, FIG. 2A depicts a top perspective view of a paint tray 200 having a base 202 and a lid 204 hingedly connected, with some added features present in the lid 204. Specifically, the lid 204 provides for storage of painting tools such as, for example, a paint brush and/or a paint roller. A brush storage compartment 210 is located on the underside of the lid. Preferably, a brush-retentions means, such as, for example, brush-retention clip 212 is located proximate the brush storage compartment 210 and preferably is adapted to help retain a brush therein by engaging the brush's handle. Those of skill in the art will appreciate that in alternative embodiments, the brush storage compartment 210 itself may include a different brush-retention means such as, for example a slidable lid, a hinged lid, a hinged bracket, a retaining clip, a magnet, a "snap-on" lid with a notch for the brush handle, a fabric retaining loop (e.g., a hook-and-loop fastening structure such as Velcro®, a snap, a button/buttonhole, or hook-and-eye fastener), or some similar or equivalent structure.

The lid 204 is also adapted for storing a paint roller. Two arcuate roller-retention brackets 220 are provided near the hinged end of the underside of the lid 204. A roller-handle-retention bar 222 is attached to the lid 204, and, in the illustrated embodiment has a hinged end 222*a* (shown in phantom lines) attached near the lid edge. The other end is a latch end 222*b* that is releasably attached to a staple-like projection 224 on the brush storage compartment 210. In alternative embodiments, one or more spring-loaded clips or other retaining means may be used to retain the handle of a roller. Preferably, one or more roller-handle-retention structures are present such that the lid 204 can be used to store different sizes and/or designs of rollers. Providing one or both of these storage structures allows a user to store a brush and/or roller without having to clean it out before pausing during a painting job (e.g., for lunch, overnight, etc.). It should be appreciated that many other retention structures may be used for retaining brushes and/or rollers in the lid.

FIG. 2B shows the paint tray 200 illustrated in FIG. 2A, with a paint roller 230 and a paint brush 232 stored in the lid 204. The bristle end of the paint brush 232 is held in the brush storage compartment 210, and its handle is held by the brush-retention clip 212. The roller end of the paint roller 230 is held by the roller-retention brackets 220, and its handle is held in place by the roller-handle-retention bar 222.

Some optional features for the paint tool storage structures may be used in other embodiments. For example, in a preferred embodiment, a disposable liner 234, formed as a translucent plastic baggie and configured to fit into the brush storage compartment 210, is provided. The disposable liner 234 allows a user to avoid having to clean paint out of the brush storage compartment 210 between uses, and decreases the likelihood that, during successive uses, old paint (e.g., from a previous use of the paint tray, such as paint that is of a different color, and/or that is dried out) may get on the paint brush. It should be appreciated that a number of other structures may be used to attach the handle of a roller 230 or brush 232 being stored in the lid 204. For example, a magnet, a hinged bar, a fabric loop, or some other structure may be provided in lieu of one or both of the roller-handle-retention bar 222 and the brush-retention clip 212.

Figure 3A:
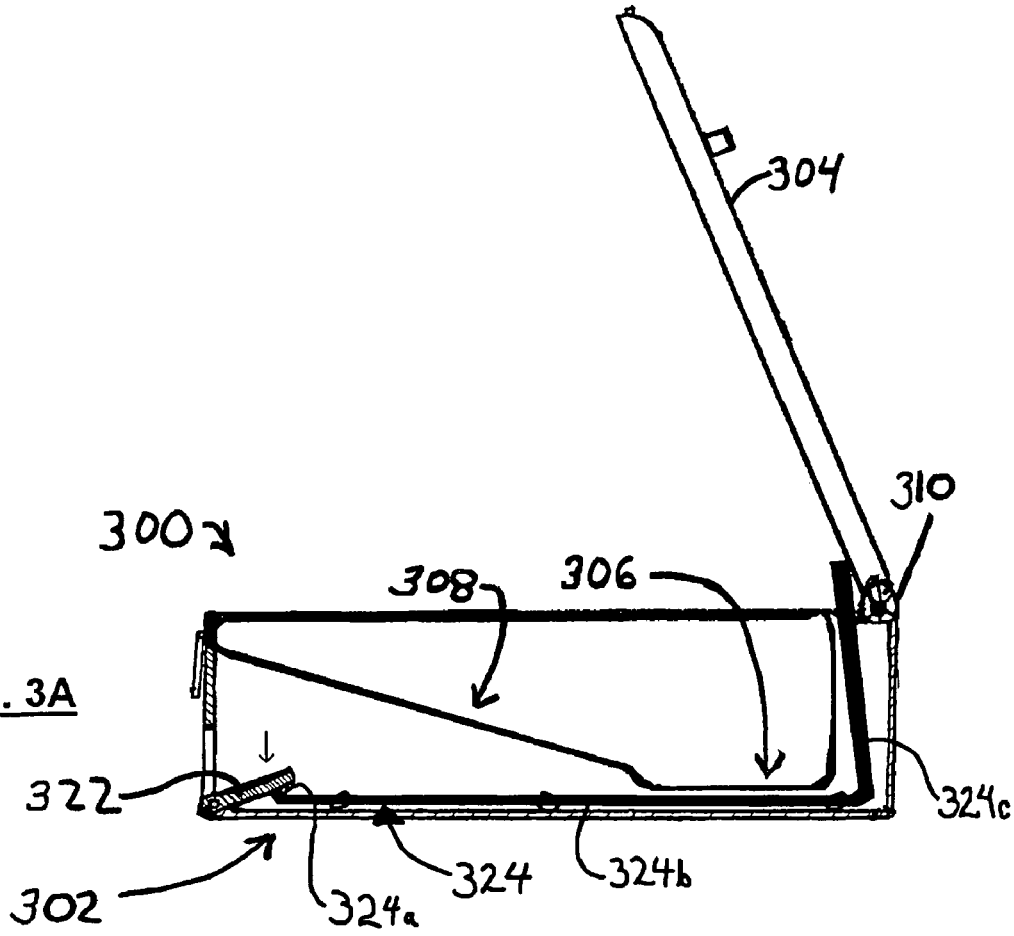
FIG. 3A is a cut-away side view of a third paint tray embodiment.
Figure 3B:
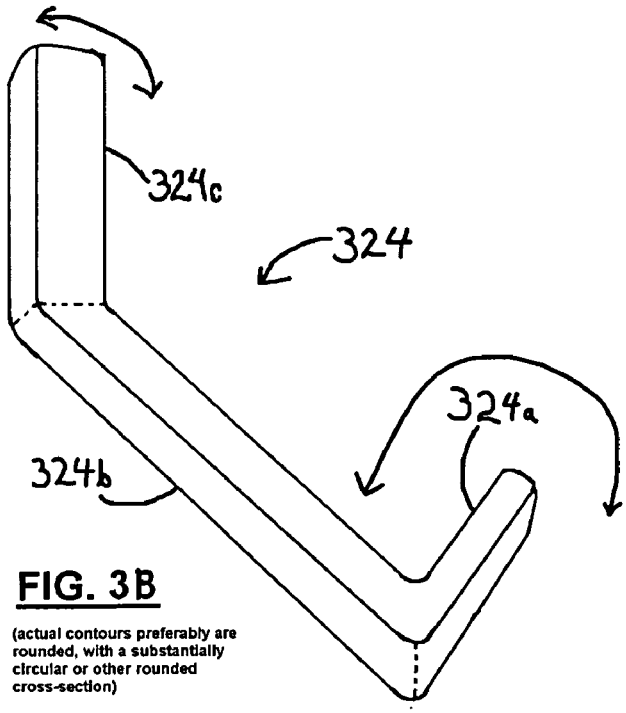
FIG. 3B is a top perspective view of a force-transmission rod.

Those of skill in the art will appreciate that other opening mechanisms may be used within the scope of the present invention. For example, lever mechanisms of the type used for foot-pedal-opening wastebaskets may be configured for use in opening a paint tray lid in accordance with the scope of the present invention. One example of a lever-type mechanism is illustrated in FIGS. 3A-3B. FIG. 3A shows a cut-away side view of the paint tray 300. The paint tray 300 includes a base 302 and a lid 304. The upper interior portion of the base 302 includes a reservoir region 306 and a ramped region 308. Preferably, the ramped region 308 is configured for convenient removal of excess paint from a brush or roller (e.g., with indentations or other irregular surface feature(s)). Also preferably, the reservoir and ramped regions 306, 308 are sized to accommodate one or more standard-sized paint rollers and disposable paint tray inserts. The lid 304 is connected to the base 302 by a hinge 310. The lower portion of the base 302 includes an opening mechanism 320 for opening the lid 304.

In the illustrated paint tray embodiment 300, the opening mechanism 320 includes a pedal 322 and a force transmission rod 324. The force transmission rod 324 in the illustrated embodiment has an offset semi-rectangular shape, preferably with a circular or other rounded cross-sectional profile, shown more clearly in FIG. 3B, which is a top perspective drawing of the rod 324. The rod 324 includes a pedal-end leg 324*a*, an elongate intermediate portion 324*b* and a lid-end leg 324*c*. The elongate intermediate portion 324*b* is rotatably attached to the base 302. When the paint tray 300 is in a closed position, the lid-end leg 324*c* is disposed at an angle off of vertical and preferably is close to or in contact with the underside of the lid 304. During operation of the opening mechanism 320, the pedal-end leg 324*a* is depressed, which rotates the rod 324 in a manner that moves the lid-end leg 324*c* toward vertical (which is the position illustrated in FIG. 3B). As the lid-end leg 324*c* is rotated toward vertical, its contact with the underside of the lid 304 pushes the lid to an open position, as is illustrated in FIG. 3A.

Figure 4:
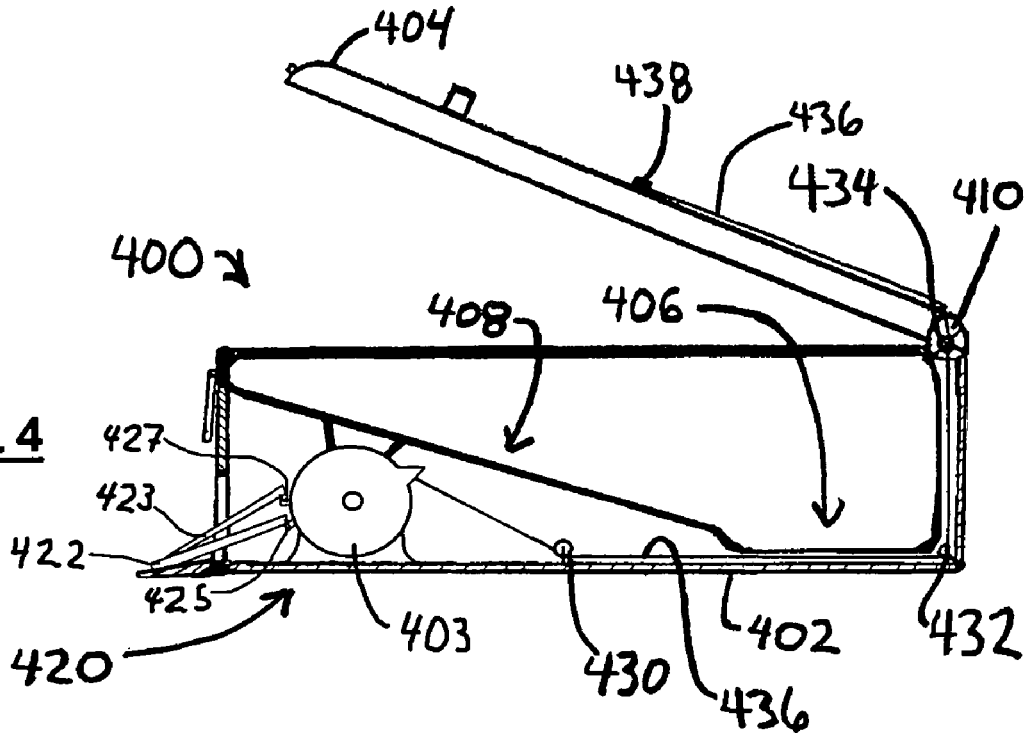
FIG. 4 is a cut-away side view of a fourth paint tray embodiment.

In another embodiment, illustrated in FIG. 4, a motorized opening mechanism may be used. FIG. 4 shows a cut-away side view of the paint tray 400. The paint tray 400 includes a base 402 and a lid 404. The upper interior portion of the base 402 includes a reservoir region 406 and a ramped region 408. Preferably, the reservoir and ramped regions 406, 408 are sized to accommodate one or more standard-sized paint rollers and disposable paint tray inserts. The lid 404 is connected to the base 402 by a hinge 410. The lower portion of the base 402 includes an opening mechanism 420 for opening the lid 404.

In the illustrated paint tray embodiment, the opening mechanism 420 includes first and second pedals 422, 423, a series of three pulleys 430, 432, 434, each of which is attached to the base 402, a motor 403 mounted to the base 402, and a cable 436 that is threaded from the motor 403 through the pulleys to an attachment 438 on the lid 404. The distal end of the first pedal 422 is in contact with a first switch 425 on the motor 403, and distal end of the second pedal 423 is in contact with a second switch 427 on the motor 403. The motor 403 preferably is a bi-directional electric motor that can be operated, for example, using battery power, A/C power, or a wind-up/spring mechanism. Preferably, actuation of the first switch 425 actuates the motor 403 in a manner that winds up or otherwise exerts tension on the cable 436 (e.g., to effect opening of the lid), and actuation of the second switch 427 actuates the motor 403 in a manner that unwinds or otherwise releases tension on the cable 436 (e.g., to allow closing of the lid).

As shown in FIG. 4, from the motor 403, the cable 436 wraps below the first pulley 430 and extends beneath the reservoir region 406 before turning upward around the second pulley 432. The cable 436 extends upward from the second pulley 432 and proceeds around the third pulley 434 to the attachment 438 on the lid 404.

The opening mechanism 420 is configured such that when a user depresses the first pedal 422, the first switch 425 is actuated such that the motor 403 is triggered to wind up the cable 436, and the resulting tension on the cable 436, as transmitted across the pulleys, pulls open the lid 404 by causing it to rotate relative to the hinge 410. The lid 404 may be easily opened by the user using, for example, her foot, hand, or an elongate tool (e.g., a paint roller on an extended handle, when the user is up on a ladder) to actuate the first pedal 422. The second pedal 423 may be actuated when a user wishes to close the lid 404, and actuation of the second pedal 423 in turn actuates the second switch 427, such that the motor 403 is activated in a reverse direction to relax tension on the cable 436, allowing the lid 404 to close. A unidirectional motor effective only for opening the lid (and being put into "neutral" to release the lid for closing) may also be used, but is less preferred. Those of skill in the art will appreciate that other powered/automated mechanisms for connecting an actuation means (such as, for example, a foot pedal, a lever, a knob, a button, or other mechanically appropriate actuation structures) operably to open the lid may be used within the scope of the present invention. For example, a series of gears, rods, or levers rather than, or in conjunction with, a cable may be used. In one contemplated (but not illustrated) embodiment that includes a bi-directional motor, the cable 436 may be actually comprise two cables, connected to the lid such that operation of the motor in a first direction exerts an opening force through the first cable, and operation of the motor in a second direction exerts a closing force through the second cable.

It is intended that the foregoing detailed description be regarded as illustrative rather than limiting, and that it be understood that it is the following claims, including all equivalents, that are intended to define the spirit and scope of this invention.

We claim:

1. A paint tray, comprising:

a base including a reservoir;

a lid hingedly connected to the base; and a foot-pedal-operable mechanism configured to open the lid, the mechanism comprising a selected one of a lever mechanism, a cable and pulley mechanism, and a force transmission rod mechanism operably connecting a foot pedal to the lid, the food pedal disposed near a bottom of the base and configured to be operable by a foot of a user;

wherein at least one of the lid and the base comprises a sealing means configured to form a seal between the lid and the base, said seal minimizing evaporation from paint contained in the reservoir, and wherein a bottom interior surface comprises a ramped surface configured to accommodate a paint roller being rolled upward thereupon from paint in the reservoir.

2. The paint tray of claim 1 wherein the selected mechanism is the cable and pulley mechanism, and comprises:

an actuation surface on the foot pedal;

at least one pulley attached to the base; and a cable connecting the actuation surface to the lid, and contacting the at least one pulley.

3. The paint tray of claim 1, wherein the lid comprises a storage structure for a paint brush.

4. The paint tray of claim 1, wherein the lid comprises a storage structure for a paint roller.

5. The paint tray of claim 1, wherein the selected mechanism is the cable and pulley mechanism, and comprises a powered motor a cable, and at least one pulley.

6. The paint tray of claim 1, wherein the mechanism is further configured to close the lid.

7. The paint tray of claim 1, wherein the selected mechanism is the force transmission rod mechanism, and comprises:

an actuation surface on the foot pedal; and at least one force transmission rod disposed between the actuation surface and the lid, the force transmission rod being configured to transmit an opening force from the actuation surface to the lid.

8. The paint tray of claim 1, further comprising a lid stop, configured to prevent the lid from opening beyond a predetermined position.

9. The paint tray of claim 1, wherein the mechanism further comprises:

an actuation surface of the pedal operably connected to a motor.

10. The paint tray of claim 9 wherein the mechanism comprises:

at least one pulley attached to the base; and a cable connecting the actuation surface to the lid, and contacting the at least one pulley;

the motor being configured to exert a tension through the cable to the lid such that the lid rotates relative to its hinged connection with the base.

11. The paint tray of claim 10, further comprising a second cable connected to the motor and the lid, and wherein the motor is a bi-directional motor configured to controlledly move the cables in a first direction and a second direction, such that when the cables move in the first direction, the cable exerts an opening force on the lid; and such that when the cables move in the second direction, the second cable exerts a closing force on the lid.

12. The paint tray of claim 1, wherein the sealing means comprises at least one gasket.

13. The paint tray of claim 12, wherein the at least one gasket comprises a non-stick surface.

14. A mechanically-opening paint tray, comprising:

a paint tray base comprising a reservoir;

a lid pivotably operably connected to the paint tray base; and a mechanical means comprising a foot-operable member connected to the paint tray base and to the lid wherein the mechanical means comprises a mechanism selected from cable and pulley, levers, force transmission rod, motor, and a combination thereof;

the mechanical means being configured such that a first actuation of the mechanical means opens the lid;

wherein at least one of the lid and the base comprises a sealing means configured to form a seal between the lid and the base, said seal minimizing evaporation from paint contained in the reservoir, and wherein a bottom interior surface comprises a ramped surface configured to accommodate a paint roller being rolled upward thereupon from paint in the reservoir.

15. The paint tray of claim 14, wherein the mechanical means is configured such that a second actuation of the mechanical means closes the lid.

16. The paint tray of claim 14, further comprising at least one storage structure attached to the lid.

17. The paint tray of claim 16, wherein the at least one storage structure is configured for storing one of a paint brush and a paint roller.

18. The paint tray of claim 14, wherein the mechanical means comprises a cable and a plurality of pulleys.

* * * * *